US005723811A

United States Patent [19]

Bouet et al.

[11] Patent Number: 5,723,811

[45] Date of Patent: Mar. 3, 1998

[54] WARHEAD HAVING A CORE GENERATING CHARGE

[75] Inventors: Thierry Bouet; Jean-Pierre Guillon, both of Orleans, France

[73] Assignee: TDA Armements SAS, La Ferte Saint Aubin, France

[21] Appl. No.: 876,433

[22] Filed: Jun. 16, 1997

Related U.S. Application Data

[63] Continuation of Ser. No. 591,143, Jan. 25, 1996, abandoned.

[30] Foreign Application Priority Data

Jun. 13, 1995 [FR] France ..... 95 06984

[51] Int. Cl.[6] ..... F42B 12/10

[52] U.S. Cl. ..... 102/476; 102/211; 102/396; 102/499; 102/501

[58] Field of Search ..... 102/211–214, 306–310, 102/396, 397, 476, 499, 501

[56] References Cited

U.S. PATENT DOCUMENTS

| | | | |
|---|---|---|---|
| 3,373,687 | 3/1968 | Simmons | 102/476 |
| 3,439,613 | 4/1969 | Thomanek | 102/476 |
| 3,483,821 | 12/1969 | Brothers | 102/476 |
| 3,818,833 | 6/1974 | Throner, Jr. | 102/476 |
| 3,960,085 | 6/1976 | Abernathy et al. . | |
| 4,026,213 | 5/1977 | Kempton . | |
| 4,584,943 | 4/1986 | Vavra et al. | 102/214 |
| 4,622,901 | 11/1986 | Witt et al. | 102/476 |
| 4,640,194 | 2/1987 | Witt et al. | 102/476 |
| 4,711,181 | 12/1987 | Ringet et al. | 102/476 |
| 4,784,062 | 11/1988 | Rudolf et al. | 102/476 |
| 4,920,886 | 5/1990 | Gabriels | 102/476 |
| 4,982,667 | 1/1991 | Weimann | 102/476 |
| 5,070,786 | 12/1991 | Hartman et al. | 102/214 |
| 5,182,418 | 1/1993 | Talley . | |
| 5,505,136 | 4/1996 | Cauchetier et al. | 102/476 |
| 5,515,786 | 5/1996 | Schilling et al. | 102/476 |

FOREIGN PATENT DOCUMENTS

| | | | |
|---|---|---|---|
| 2 704 052 | 10/1994 | France . | |
| 2276436 | 9/1994 | United Kingdom | 102/213 |

*Primary Examiner*—Harold J. Tudor

*Attorney, Agent, or Firm*—Oblon, Spivak, McClelland, Maier & Neustadt, P.C.

[57] ABSTRACT

A warhead includes an explosive charge placed in a confinement casing and bounded towards a front portion by a liner, the entire warhead having an axis of symmetry of revolution. A detector is provided in front of the charge and processing and command circuits are provided in a rear portion of the charge. A multiple-point detonator is communicated with an axial space providing a detector-circuit link without harming the efficiency of the charge.

16 Claims, 1 Drawing Sheet

WARHEAD HAVING A CORE GENERATING CHARGE

This application is a Continuation of application Ser. No. 08/591,143, filed on Jan. 25, 1996 now abandoned.

BACKGROUND OF THE INVENTION

FIELD OF THE INVENTION

The present invention relates to a warhead, especially with a core-generating charge.

DISCUSSION OF THE BACKGROUND

The problem that arises for warheads in general is that of providing a physical link through the explosive charge, in particular to enable the passage of information, and of achieving this result without adversely affecting the effectiveness of the warhead. This problem is an especially delicate one in the case of a warhead with a core-generating charge.

Such a charge generally has a symmetry of revolution about an axis 7 and, from the front to the rear along this axis, as shown in FIG. 1, it has a liner 4 designed to be ejected, an explosive charge 3 and a confinement casing 5. For an adequate shape of the liner 4, there is obtained a core that is a solid projectile driven at high speed during the operation of the explosive charge. To fire this charge, there is provided a priming device 1 positioned axially in the rear of the charge. The directivity and firing range of a charge of this kind implies that it should be associated with a detector 6, show in FIG. 1, for example a millimetrical antenna or an infrared detector, that activates the firing by means of the priming device 1. It is therefore necessary to provide for a link between the detector 6 and the electrical activation of the priming device 1, and to do so without destroying the symmetry of revolution of the charge, failing which the effectiveness of this charge will be greatly reduced (by the destructuring of the core, reduction of speed etc.).

In one known approach, the necessary electronic circuits are placed within a mask 2 (FIG. 1) buried in the explosive. This mask is also used to shape the detonation waves. However, the practical operation of manufacturing such circuits is a very delicate one as regards the positioning of the mask, the resistance of the charge to ambient conditions during manufacture and the problems resulting from the fact that the electronic and detonating functions are not separated from each other. Furthermore, the links between the detector 6, the mask 2 and the priming device 1 destroy the symmetry of revolution of the charge 1 especially because of the presence, on the axis 7, of the detonator 1.

In another approach, the information is made to travel through the exterior of the charge. This entails the drawback of the risk of losses for the transmission of microwave signals, especially because of the curvature of transmission lines as well as the drawbacks resulting from the need for through channels along the casing that increase the cost and caliber of the charge.

SUMMARY OF THE INVENTION

An object of the invention therefore is a warhead whose structure can be used to overcome all these drawbacks.

According to a first aspect of the invention, there is provided a warhead of the type comprising an explosive charge with a symmetry of revolution about an axis and priming means positioned in the rear of the charge along said axis, wherein said explosive charge is crossed by an axial channel extending along said axis so as to ensure the passage of links between the front and the rear of the charge and wherein said priming means are formed by a multiple-point priming device comprising at least three detonators positioned outside the axis.

The combination of a multiple-point priming device releasing an axial space and an axial through channel provides for a direct passage of links between the front and the rear of the charge without any detrimental effect on the symmetry of revolution of this charge and hence without detrimental effect on its efficiency.

According to a more specific aspect of the invention, there is provided a warhead with a core-generating charge comprising an explosive charge delimited towards the front by a liner, having axial symmetry with respect to said axis, detector means positioned in the front of said head before the explosive charge and electrical processing and/or control means positioned in the rear of said explosive charge enabling the activation of said priming device, wherein said channel enables the passage of at least the electrical links between said detector means and said electrical processing and/or control means and wherein said detonators are distributed symmetrically about said axis.

BRIEF DESCRIPTION OF THE DRAWINGS

The invention will be understood more clearly and other features and advantages shall appear from the following description and from the appended drawings, wherein.

DESCRIPTION OF THE PREFERRED EMBODIMENT

For the simplicity of the explanation, the case of a warhead with a core-generating charge shall be described without in any way thereby restricting the scope of the invention.

Figure 1:
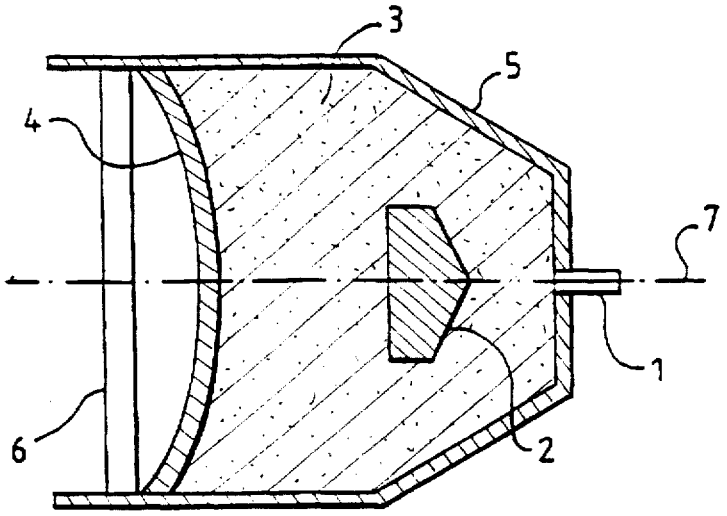
FIG.1 PRIOR ART
FIG. 1 shows a warhead with a known core-generating charge.

FIG. 1 which shows the drawing of a known warhead has already been described in the above introduction.

Figure 2:
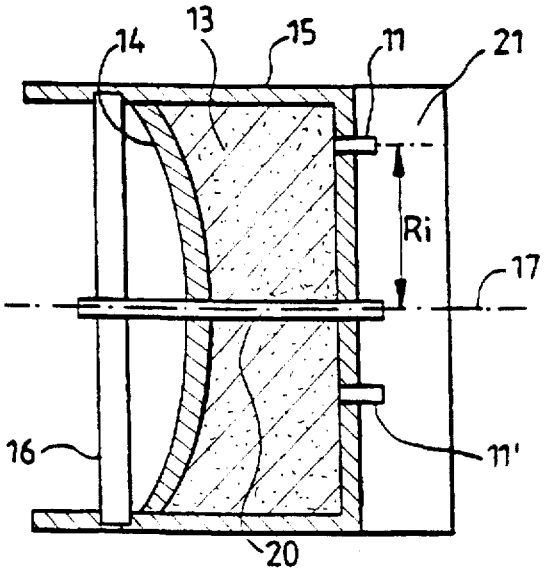
FIGS. 2 and 3 show a warhead according to the invention seen in a longitudinal view and from the rear.
Figure 3:
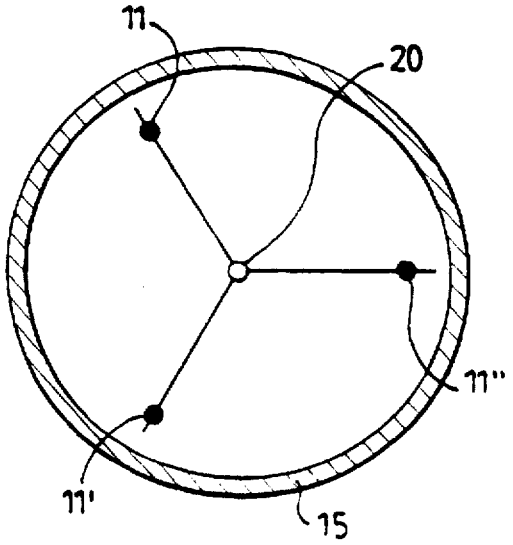

FIGS. 2 and 3 pertain to the approach of the invention applied in the case of a core-generating charge. This charge contains an explosive charge 13 placed in a confinement casing 15 and bounded towards the front along the axis of symmetry of revolution 17 by a liner 14 that enables the creation of the core. The detonator 1 of FIG. 1 is replaced by a multiple-point priming device comprising three detonators 11, 11', 11" distributed symmetrically in the rear of the charge. These detonators are positioned on three radii at 120° with respect to one another (FIG. 3) and define a circle whose radius Ri preferably ranges from 0.1 to 0.5 times the caliber. Of course, it is possible to provide for a greater number of detonators presuming that their distribution remains symmetrical with respect to the axis 17.

Furthermore, to determine the instant of firing of the charge, it is necessary to position a detector 16 (for example a millimetrical antenna) in the front of the charge. Moreover, electrical means 21 to process the signal from the detector 6 and to activate the priming of the detonators 11, 11', 11" are positioned in the rear of the charge. In the example shown, these means are contained in a pancake element positioned against the back of the casing 15. They could also be positioned in a pancake element placed at the back of the casing 15 between this casing and the explosive charge 13, the detonators being then placed against that face of the pancake element which is pointed towards the explosive charge. The means 21 may also be positioned further to the rear of the charge without in any way thereby modifying the principle of the invention. In any case, there is provided, according to the invention, an axial channel 20 extending along the axis 17 going through the explosive charge 13 from one side to the other so as to form a passage through which the links between the detector 6 and the electrical means 21 can pass. Since the channel 20 is axial and extends along the axis of symmetry 17, it in no way disturbs the detonation waves within the charge and hence the effectiveness of the core obtained.

This channel 20 may be simply a cylindrical hollow portion that is left in the explosive charge 13 and leads into axial holes in the liner 14 and the bottom of the casing 15. Alternatively, it could be formed by means of a cylindrical hollow tube, for example a metal tube as shown in FIG. 2. This channel 20 enables the passage of electrical links or a microwave guide. It could be formed by a waveguide proper about which there would be molded the explosive charge, provided that it is designed to stand up to the ambient conditions of the charge during manufacture and to the stresses arising during the launching of the warhead.

A structure of this kind according to the invention has many advantages, related especially to the combination of an axial symmetry that is preserved despite the presence of a linking channel and a multiple-point priming system. These advantages are:

the energy efficiency of the charge which is improved as compared with the standard approach, thus enabling the use of a height of explosive in the axial direction that is substantially reduced (by a ratio of over 2.5);

the complete separation of the detection and pyrotechnic functions through the direct axial passage that preserves the symmetry of revolution. This facilitates the manufacture, integration, control and maintenance of the system;

a core with improved performance owing to higher aerodynamic drag giving rise to lower loss of speed on its trajectory, this result being brought about in particular by the multiple-point priming system that enables the control of the formation of fins having a stabilizing role during the flight stage of the core.

Of course, the exemplary embodiment described in no way restricts the scope of the invention. In particular, the axial channel may enable the passage of not only electrical links but also mechanical or optical links between the front and rear of a charge. This may have applications for core-generating charges as well as for military payloads in general, especially for missile architecture.

What is claimed is:

1. A warhead which comprises:

a casing;

an explosive charge positioned in the casing and having an axis of symmetry of revolution;

a detector located at a front portion of the charge;

priming means positioned at a rear portion of the charge; and one of an electrical processing means and a control means enabling actuation of said priming means and which is located on a rear exterior surface of the casing;

wherein the explosive charge is delimited by a liner and includes an axial hollow channel, said channel comprising a microwave guide, said channel and said microwave guide both extending along said axis of symmetry through the explosive charge, the liner and the casing, the microwave guide forming a microwave link between the detector and said one of said electrical processing means and said control means; and wherein said priming means comprises a multiple-point priming device extending through a rear exterior surface of the casing to a front interior surface of a base of the casing, said multiple-point priming device comprising at least three detonators positioned outside the axis.

2. A warhead according to claim 1, wherein said channel comprises a cylindrical hollow tube located in the explosive charge.

3. A warhead according to claim 2, wherein said tube comprises a metal tube.

4. A warhead according to claim 1, wherein said channel comprises a hollow tube which extends from the rear exterior surface of the casing to the detector.

5. A warhead which comprises:

a casing;

an explosive charge positioned in the casing and having an axis of symmetry of revolution;

a detector located at a front portion of the charge;

priming means positioned at a rear portion of the charge; and one of an electrical processing means and a control means enabling actuation of said priming means and which is located on a rear exterior surface of the casing;

wherein the explosive charge is delimited by a liner and includes an axial hollow channel, said channel comprising one of electrical links and a microwave guide, said channel and said one of said electrical links and said microwave guide both extending along said axis of symmetry through the explosive charge, the liner and the casing, said one of said electrical links and said microwave guide forming a link between the detector and said one of said electrical processing means and said control means; and wherein said priming means comprises a multiple-point priming device extending through a rear exterior surface of the casing to a front interior surface of a base of the casing, said multiple-point priming device comprising at least three detonators positioned outside the axis.

6. A warhead according to claim 5, wherein said channel comprises a cylindrical hollow tube located in the explosive charge.

7. A warhead according to claim 6, wherein said tube comprises a metal tube.

8. A warhead according to claim 5, wherein said channel comprises a hollow tube which extends from the rear exterior surface of the casing to the detector.

9. A warhead which comprises:

a casing;

an explosive charge positioned in the casing and having an axis of symmetry of revolution;

a detector located at a front portion of the charge;

priming means positioned at a rear portion of the charge; and one of an electrical processor and a control device controlling activation of the priming means and which is located on a rear exterior surface of the casing;

wherein the explosive charge is delimited by a liner and includes an axial hollow channel, said channel comprising a microwave guide, said channel and said microwave guide both extending along said axis of symmetry through the explosive charge, the liner and the casing, the microwave guide forming a microwave link between the detector and said one of said electrical processor and said control device; and wherein said priming means comprises a multiple-point priming device extending through a rear exterior surface of the casing to a front interior surface of a base of the casing, said multiple-point priming device comprising at least three detonators positioned outside the axis.

10. A warhead according to claim 9, wherein said channel comprises a cylindrical hollow tube located in the explosive charge.

11. A warhead according to claim 10, wherein said tube comprises a metal tube.

12. A warhead according to claim 9, wherein said channel comprises a hollow tube which extends from the rear exterior surface of the casing to the detector.

13. A warhead which comprises:

a casing;

an explosive charge positioned in the casing and having an axis of symmetry of revolution;

a detector located at a front portion of the charge;

priming means positioned at a rear portion of the charge; and one of an electrical processor and a control device enabling actuation of said priming means and which is located on a rear exterior surface of the casing;

wherein the explosive charge is delimited by a liner and includes an axial hollow channel, said channel comprising one of electrical links and a microwave guide, said channel and said one of electrical links and a microwave guide both extending along said axis of symmetry through the explosive charge, the liner and the casing, said one of electrical links and a microwave guide forming a link between the detector and said one of said electrical processor and said control device; and wherein said priming means comprises a multiple-point priming device extending through a rear exterior surface of the casing to a front interior surface of a base of the casing, said multiple-point priming device comprising at least three detonators positioned outside the axis.

14. A warhead according to claim 13, wherein said channel comprises a cylindrical hollow tube located in the explosive charge.

15. A warhead according to claim 14, wherein said tube comprises a metal tube.

16. A warhead according to claim 13, wherein said channel comprises a hollow tube which extends from the rear exterior surface of the casing to the detector.

* * * * *